United States Patent [19]

Weaver et al.

[11] 4,219,117

[45] Aug. 26, 1980

[54] MULTIPACKAGING DEVICE

[75] Inventors: William N. Weaver, Northbrook; Robert C. Olsen, Streamwood; Mindaugas J. Klygis, Barrington, all of Ill.

[73] Assignee: Illinois Tool Works Inc., Chicago, Ill.

[21] Appl. No.: 31,231

[22] Filed: Apr. 18, 1979

[51] Int. Cl.[3] ..... B65D 75/00

[52] U.S. Cl. ..... 206/150; 206/158; 206/161

[58] Field of Search ..... 206/150, 199, 390, 428, 206/158, 161

[56] References Cited

U.S. PATENT DOCUMENTS

| | | | |
|---|---|---|---|
| 3,232,422 | 2/1966 | Whyte | 206/150 |
| 3,733,100 | 5/1973 | Tanzer | 206/150 |
| 3,874,502 | 4/1975 | Weaver | 206/150 |
| 4,018,331 | 4/1977 | Klygis | 206/199 |
| 4,033,457 | 7/1977 | Weaver | 206/390 |
| 4,064,989 | 12/1977 | Olsen | 206/428 |
| 4,109,787 | 8/1978 | Klygis et al. | 206/150 |
| 4,121,712 | 10/1978 | Cunningham | 206/150 |
| 4,149,631 | 4/1979 | Cunningham | 206/150 |

*Primary Examiner*—Joseph Man-Fu Moy

*Attorney, Agent, or Firm*—Thomas W. Buckman; Robert W. Beart

[57] ABSTRACT

A multipackaging device made from resilient plastic material and flat strip stock for producing a plurality of such devices. The strip comprises a pair of rows of bands of laterally aligned container encircling bands, each which define noncircular apertures. The plurality of bands are integrally connected by first web means joining laterally aligned pairs of bands and second web means joining longitudinally adjacent bands in a given row. The laterally innermost section of each band being generally V-shaped with an apex region and pair of legs extending from each apex with the first web means connecting laterally opposed legs of each pair of laterally aligned bands. This construction permits the strip to be stretched laterally by application of forces solely at the outer edge of the strip so each aperture is reconfigured from a noncircular aperture to a substantially circular aperture for application about a container.

17 Claims, 7 Drawing Figures

MULTIPACKAGING DEVICE

BACKGROUND OF THE INVENTION

This invention pertains to sheet plastic devices for forming packages of a plurality of containers. More particularly, the invention relates to a multipackaging device and strip stock for producing such multipackaging devices for a predetermined number of generally cylindrical can-type containers disposed in two rows.

There are various forms of such multipackaging devices in the prior art. Most of these devices, which include those shown in U.S. Pat. Nos. 2,874,835—3,733,100—3,711,145—3,874,502 and 4,018,331, not only produced reliable packaging but were adapted for use with various relatively efficient carrier applicating machines and methods. Most of the known machines and methods for applying such plastic multipackaging devices to containers utilize a pair of laterally opposing jaws or jaw-like stretching members associated with each aperture in the device to carefully stretch and temporarily enlarge the aperture through the application of lateral stretching forces at spaced circumferential regions of the aperture so they may be snapped over the chimes of containers. Other methods and machines utilize pin-type members that move relative to and about a predetermined peripheral extent of the aperture and the chimes of a container to progressively snap the band creating the aperture about the periphery of and beneath the chimes of the individual containers.

A carrier device of the type generally described should include a series of bands which delineate the container receiving apertures and which create a package with the bands exerting sufficient compressive stress about the container so that the containers will not be inadvertently removed from the device but are still capable of selective removal from the device. Thus, the forces stretching the strip must cooperate with the carrier in such a manner as to provide the necessary holding force in the device without unduly stressing the carrier beyond its elastic limit at any given region.

While certain prior art carriers, methods and machines have proven to be commercially successful, it has been found that simpler methods may not utilize the controlled stretching of each aperture of the multipackaging device as discussed above. For example, in U.S. Pat. No. 4,018,331 a carrier device for three rows of containers is applied by a machine which stretches a carrier strip by application of forces solely at the outer margins of the three lane strip. The U.S. Pat. No. 4,018,331 carrier design incorporates a series of bands and webs creating apertures designed to be reconfigured to three lanes of lateraly aligned container receiving apertures due to the application of force to the outer margins of the laterally outermost rows. It is noted that this carrier and strip stock, since it is particularly designed for application to three or more rows of containers, will have the benefit of the inner lane of material to resist and react to the stretching forces.

In addition to the above noted use of two jaws on a strip of carrier stock for three or more lanes, it has also been suggested in U.S. application, Ser. No. 908,593, that a carrier strip for two or more lanes of containers may be applied thereto solely through the use of the cans themselves applying a lateral stretching force on the outer bands of the stock.

SUMMARY OF THE INVENTION

With the above background of carrier design emerging new technology in applicating methods and machines, it is a primary object of this invention to provide a multipackaging device adapted for machine application on two rows of containers with the device being particularly designed to be transformed from noncircular apertures to substantially circular apertures upon application of stretching forces solely at the outer marginal regions of the strip.

Another object of the invention is to provide a carrier device and strip stock for selectively severing predetermined lengths of carrier device from the stock, with the carrier device of a design which will minimize the material used and still permit the use of a single pair of force applying means exerted at the outer margins of the carrier strip.

The invention is capable of utilization with high-speed applicating machines where two lanes of laterally aligned containers are selectively packaged by transversely stretching a strip stock of carrier device material solely from the outer margins of the strip rather than reconfiguring or manipulating each individual aperture in the strip. In such a system, in order to be adaptable for high-speed operation, the aperture of the carrier device as it is about to be applied to the containers should be substantially circular so that uneven resistance or frictional contact between the upper rim of the container and inner periphery of the bands is controlled.

The carrier device described herein includes two rows of laterally aligned aperture delineating bands. The laterally aligned bands are mirror image identical and form an initial noncircular aperture. The bands include a generally straight outer band section and a V-shaped inner band section having a pair of leg sections intersecting at an apex. A web interconnection between laterally aligned bands is configured so that the longitudinal extremities of the web interconnect the opposing legs in regions on either side of the apex. Thus, when a lateral stretching force is applied to the outer margins of the strip, the longitudinal extremities of the web react to the stretching force by deforming the leg from a generally straight line to an arc which forms part of a circular reconfiguration of the aperture. A preferred embodiment of the invention utilizes bands configured into a generally isosceles triangle with the equal sides forming the legs which are to be reconfigured. The preferred embodiment of the web utilizes a plurality of longitudinally spaced straps with the end straps of each plurality interconnecting opposing leg sections of the triangular band intermediate the apex of the band and the juncture of the leg with the outer band region. A third strap may be provided intermediate the outer straps and which interconnects the apex regions of the band. Other modifications of this basic invention will be shown and described in the specification.

The carrier and carrier stock just described and which will be described later herein not only is designed particularly to be efficiently applied to two rows of containers by stretching forces at the outer margins but also creates a carrier by using less material than previous carriers and still embody tensile strength and tension on the containers that is necessary to create an acceptable package. Also, the longitudinal extremities of the web between laterally aligned pairs of bands creates finger gripping edges in finger holes for comfortably carrying the package.

Other objects, advantages and features of the invention will be apparent from the following description when taken in conjunction with the drawings.

DETAILED DESCRIPTION OF THE PREFERRED EMBODIMENTS OF THE INVENTION

Figure 1:
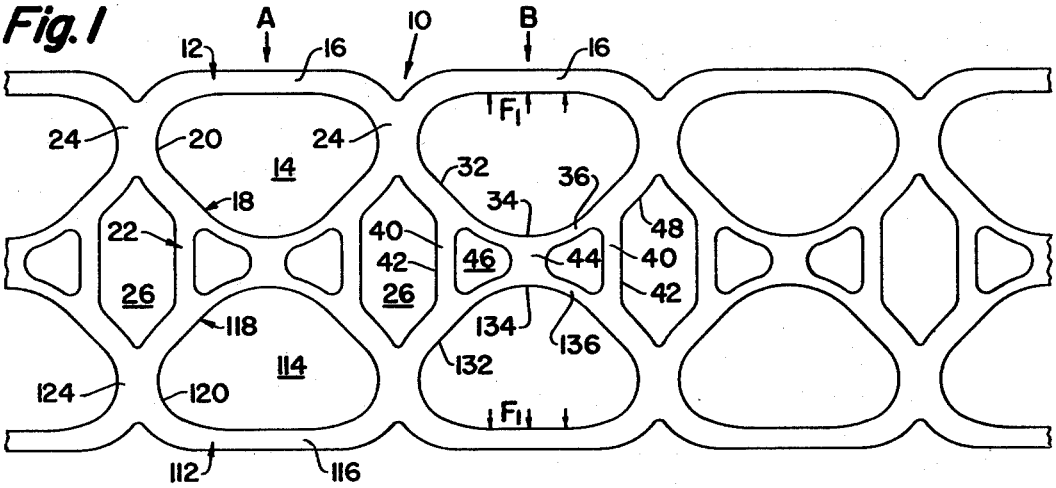
FIG. 1 is a plan view of a section of a strip used to produce one embodiment of the invention.

Turning to FIG. 1, a brief description of the general configuration of carrier strip stock 10 will first be provided followed by a more detailed description of the particular components of the stock and carrier device that are important to the invention.

Strip stock 10 is designed to be selectively severed transverse of its length to produce carrier devices for a predetermined number of containers arranged in two rows. For purposes of this description the term "longitudinal" shall define dimensions or direction of elements of the invention relative to the elongated direction of the strip while terms "laterally" or "transverse" define dimensions or direction of elements in the width direction of the two lane strip. The stock will be seen to include laterally aligned pairs of mirror image identical bands adapted to encircle predetermined regions of a container, such as the region directly beneath the chime of a can. For purposes of this description, the bands and components thereof associated with the bands for each embodiment will be provided with identical reference characters with the addition of a prefix "1" identifying the identical mirror image components of the strip.

A series of bands 12 are configured to produce a series of apertures 14, which are of a circumferential dimension less than the dimension of the container surface to be encircled. A general description of the elements of the invention will be best understood by referring to the laterally aligned pair of bands "A" in FIG. 1. The bands 12,112 incorporate a generally straight outer band section 16,116 and a substantially V-shaped or yoke-shaped inner band section 18, 118. The V-shaped inner band section 18, 118 is integrally connected to its associated substantially straight outer band section 16,116 by a radiused corner region 20,120. The apices of bands 12 and 112 are integrally connected to one another by a first web means 22. The longitudinally adjacent bands 12 on either side of the first web 22 are integrally connected by second web means 24 or 124. The longitudinal extremities of each first web means 22 and selected outer margins of the inner sections 18,118 and second web means 24, 124 create an aperture 26 which can serve as a finger hole to facilitate carrying the package formed by the carrier device and the container.

A more detailed description of the configuration of the bands and more importantly the novel configuration and function of the webs that interconnect laterally aligned pairs of bands can be best understood with reference to the pair of bands denoted as "B" in FIG. 1.

Each inner band section 18 incorporates a pair of generally straight legs 32 interconnected at an apex 34 in a V-shaped or yoke-like configuration. The apex 34 is preferably radiused and creates an included angle of about 90° between the legs in this embodiment. While the outer band sections 16 and leg regions 32 are shown to be straight sections, it should be understood that leg and outer band sections which are of a very large radius about the center of the aperture compared to the radius of junction regions 20 and apex 34 are contemplated in the invention. The first web means 22 interconnecting laterally aligned pairs of bands 12 and 112 overlaps the apex 34,134 and therefore extends to longitudinal positions on either side of the aligned apices. More particularly, it should be noted an important feature of the invention whereby the extremities 42 of this web interconnect the opposing leg regions 32 and 132 at regions intermediate the apex 34,134 and junction 20,120. Thus, there is no connection between the laterally aligned inner regions 18 and 118 longitudinally beyond the extremities 42 of the first web. A portion of the generally straight legs 32,132 remain unconnected between the extremities 42 of this web and the adjacent second web connections 24 or 124.

In a preferred embodiment shown in FIG. 1, the extremities of the first web 22 are created by a pair of longitudinally spaced straps 40. Each of these straps interconnect laterally opposed leg regions 32,132 on both sides of apices 34 and 134. The apices 34 and 134 of the bands are also connected by a relatively narrow, intermediate, center strap 44, thus creating a pair of generally triangular, small apertures 46, between the outer straps 40 and the inner strap 44 and relieving the total interconnection between bands 12 and 112.

Figure 2:
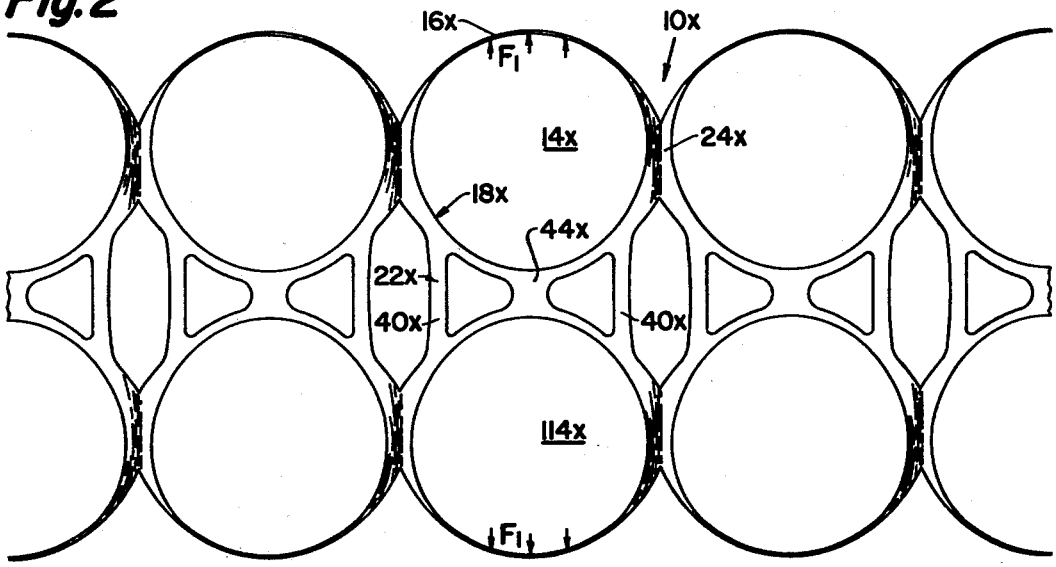
FIG. 2 is a plan view of the strip embodiment of FIG. 1 in a stretched configuration.

Since a purpose and particular function of the carrier device and strip stock just described is to permit the efficient application of such a carrier on containers arranged in two rows by applying stretching forces solely at the laterally outer margins of the stock, attention is directed to force vectors F1 in the just described pair of bands in FIGS. 1 and 2. As the strip 10 is placed in operative aligned relationship over two rows of containers and a force is applied to outer bands 16 and 116 in the position noted in FIG. 1, the strip will be reconfigured as **10*x* in FIG. 2. The force applying instruments may be arcuate jaws or jaw-like members which will bend or stretch outer bands 16,116 approximately 90° to the plane of the strip but more importantly reconfigures straight sections 16,116 into arcuate portions of a circle 16*x***.

Continuing combined reference to FIGS. 1 and 2 will identify the importance of the configuration of inner band sections and webs in the invention. In FIG. 2, reference characters with the suffix "x" denote original regions of the carrier which have been reconfigured as the result of the stretching force. It should be noted that aperture **14*x* is now almost completely circular as opposed to the generally triangular configuration 14. This circular reconfiguration results from the novel positionment and structure of the bands and webs. For example, outer extremities of the first webs, which in the preferred embodiment are straps 40, react to the high stretching forces F1 by forming the generally V-shaped inner band section 18 into a generally semicircular section 18x. As noted above, the straight outer band section 16 has been transformed into a generally semicircular section 16x. The web 22 between identical bands 12 and 112 thus not merely absorbs the stretching forces but more importantly reconfigures the aperture 14 to an aperture 14x, which is acceptable for being pulled down or snapped over the chimes on a container with a minimum of frictional resistance. Second web means 24 also play an important part in reacting to these stretch forces. It should be noted that each of the web means 22 and 24 not only must react to a pure lateral force but to a slight longitudinal force since the strip stock 10 is not totally free to react to the stretching forces in its longitudinal direction. It is either restrained by previous application on containers or by jaws which are soon to be stretching the stock. The webs 24,124 contribute to the reconfiguring of the aperture by reacting and controlling the forces in the regions of junctions 20,120** of the aperture.

While all the reasons for this novel reconfiguring of aperture 14 from a noncircular, generally triangular configuration to a circular aperture 14x are not entirely explained, it is believed that the positionment of the longitudinal outermost extremities 42 of the web 22 so that they are intermediate the apex 34 and the interconnection of the leg 32 with the junction region 20 and second web 24 contribute greatly to the creation of a novel force reacting and reconfiguring characteristic.

As noted, the web 22 may, in a preferred embodiment, be either a plurality of straps with longitudinally spaced straps 40 and intermediate straps 44. However, any number of variations of this configuration are contemplated in the invention and they will be described later herein. In all configurations, it should be noted that the band segments and associated components in the strip 10 are relatively narrow as compared to some prior art devices. This permits the bands to function indpendently and to isolate the force application and reaction of these forces to each band and the resulting uniform stretching of the bands to maximize the resilient engagement of the band beneath the chimes of containers. In fact, the distribution of forces and arrangement of web means 22 permits leg portions 36 between intermediate strap 44 and outer straps 40 to be even less width than the remaining regions of the bands. The intermediate strap may accordingly be of limited width generally not exceeding twice the width of regions 36 for best results.

The independent functioning of each band is important when stretching forces are applied solely to the outer regions of the strip rather than utilizing the controlled aperture configuring forces as were dominant in the prior art. Since the forces F1 required to stretch the strip 10 are substantial and particularly with material such as low density polyethylene having thickness generally in the 17–20 mil range, localized application of high stretching forces and stress concentrations at any region of the band could produce a stretching beyond the elastic limit of the bands at any particular region. Since the ultimate desire of a design of a carrier device is to produce a reliable package, that is a package which will retain a set or series of containers as a unit without unintentional dislodgment of the container from the carrier, it is vital that the individual bands present or offer sufficient tension to retain their associated container in the aperture.

Figure 3:
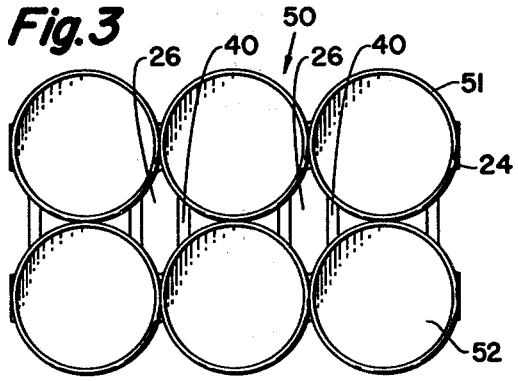
FIG. 3 is a top plan view of a package made with one of the devices of the strip of FIG. 1.
Figure 4:
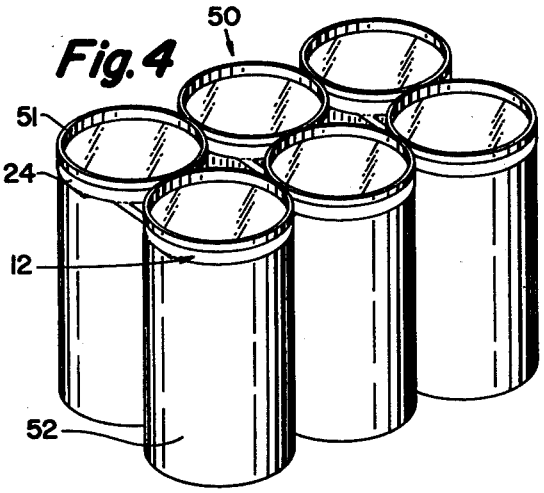
FIG. 4 is an isometric view of the package shown in FIG. 3.

The packages shown in FIGS. 3 and 4 created by the carrier device of this invention do provide sufficient tension to create a package 50 which is not only easy to handle but which reliably retains the containers in the package for selective individual removal from the package. For example, in package 50, a plurality of can-type containers 52 preferably having chime means 51 are compactly secured and retained by a series of three sets of bands 12,112. The aperture 26 created virtually by the extremities of the webs 22 and more particularly by the edges of straps 40, in the preferred embodiment, create a finger hold region enabling the user to grasp the package. Second web means 24 are configured so that a selective severing of the strip will produce packages of any desired groups of two containers without creating a narrowing of the band in the region of the juncture 20. The limited lateral extent of webs 24 and limited interconnection of band 12,112 provided by web 22 permits each band to function independently in retaining their associated container. In other words, the minimization of material in the carrier strip and the location and relative widths and lengths of the strap means 40 and 44 and webs 24 not only permits and contributes to accurately reconfiguring the aperture but permit the bands 12, 112 to function independently almost as if they were unencumbered rubber bands enveloping each neck of the containers 52 without substantial interdependence or reaction from the other regions of the stock.

While the invention has been described above in connection with a preferred embodiment, it should be understood that it is not intended to limit the invention to that embodiment. Therefore, to better identify the spirit and scope of the invention, several alternate embodiments will be described. In describing these embodiments, like reference numerals will be used throughout the various views of FIGS. 5–7 with suffixes "a" or "b" or "c" designating similar elements in different embodiments. Consistent with the technique utilized relative to the embodiment in FIGS. 1–4, mirror image identical components of laterally opposed band sections are denoted as having a prefix "1".

Figure 5:
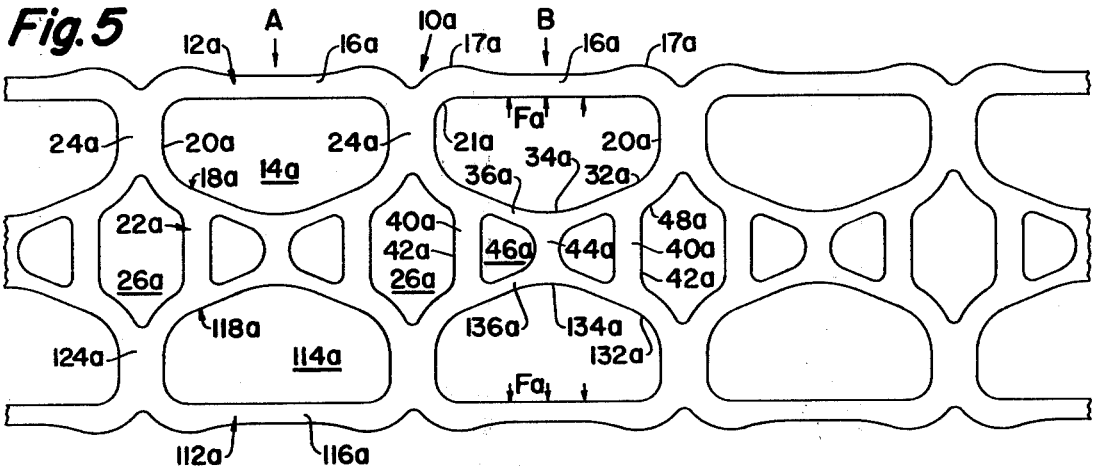
FIG. 5 is a plan view of a section of a strip used to produce an alternate embodiment of the invention.

FIG. 5 shows a strip 10a which is particularly adapted for use in a machine which utilizes the outer upper rim of the containers themselves as force applying elements. This technique is more particularly described in a U.S. co-pending patent application, Ser. No. 908,593. As in the preferred embodiment, the strip 10a includes two rows of laterally aligned bands 12a and 112a. Each band creates an aperture 14a or 114a and comprises an outer band section 16a, 116a and an inner band section 18a,118a. In this embodiment, however, it has been found desirable to maximize the length of the straight outer band section 16a since this outer band is to be initially positioned over the outer rims of laterally opposed containers and will not have the benefit of partial reconfiguring jaws. Band 16a is joined to the inner band section 18a by a generally straight section 20a extending perpendicularly to the outer sections. The straight outer section and intermediate section 20a are joined by a small radius 21a rather than the larger radius utilized in the triangular configuration of FIG. 1. This long straight section 16a and perpendicular section 20a facilitates the initial positionment of the outer can region in the aperture so that it may create the lateral stretching forces necessary to completely assemble the carrier. Thus, this embodiment has a band configuration which is polygonal rather than triangular but which still includes the V-shaped inner band section. Turning to the details of the inner band section and the webs, with specific reference to the pair of bands denoted "B" in FIG. 5, it will be seen that the leg regions 32a are joined by an apex region 34a of a somewhat larger included angle than that of the preferred embodiment in order to better meet the demands of the use of the can as the force applying element rather than a shoe or jaw member at the outer band. As in the preferred embodiment, a first web means 22a is located to interconnect the opposing band elements and more particularly the leg elements 32a and 132a in regions which lie on either side of the apex 34a and 134a and intermediate the apex and second web 24a,124a. The first web will preferably comprise a pair of longitudinally spaced strap members 40a with an intermediate centrally disposed strap member 44a interconnecting the apexes.

To compensate for the high unit stress that may be placed on the small radiused corners 21a between the straight section 20a and straight outer section 16a, the outer strap may be widened slightly in the region of the corners, such as shown by bulges 17a.

Again, in keeping with the invention, this carrier strip 10a is designed to be reconfigured from a noncircular aperture to a circular aperture through the application of forces solely at the outer band sections as noted by force lines "Fa" in the FIG. 5.

Figure 6:
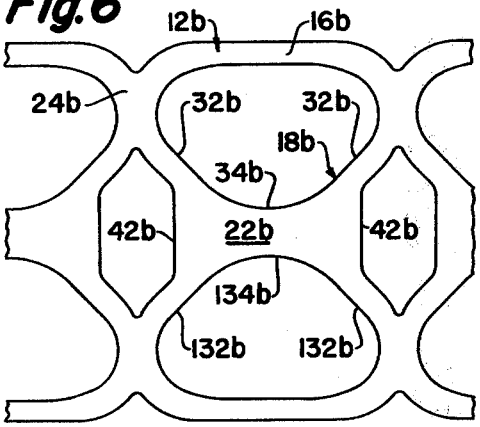
FIG. 6 is a partial plan view of a strip showing an alternate configuraton of an interconnecting web for the invention.
Figure 7:
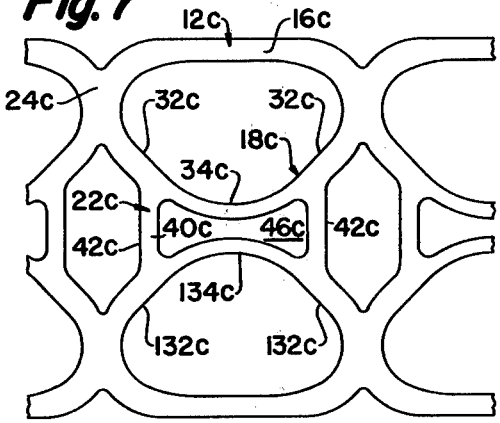
FIG. 7 is a partial plan view of a strip showing another alternate configuration of an interconnecting web for the invention.

FIGS. 6 and 7 show two further modifications of the invention illustrating different configurations of first webs. FIG. 6 indicates that the first web interconnecting laterally aligned bands may comprise an infinite number of strap members as indicated by the solid web 22b, as long as the longitudinal, outermost extremities 42b connect opposing legs 32b,132b intermediate the apex 34b of the V-shaped inner section 18b and the other extremity of the associated leg, therefore, permitting the opposing legs 32b and 132b to react to the stretching forces and reconfigure that segment of the band from a V-shaped to a semicircular shape.

FIG. 7 indicates that the web 22c between laterally aligned bands may include only a pair of longitudinally spaced straps, such as 40c, with complete relief between the straps and, therefore, no connection between the apices 34c and 134c.

While the embodiments shown in FIGS. 6 and 7 are shown in conjunction with a generally triangular band, it should be understood that either the triangular aperture of FIG. 1 or the pentagonal aperture of FIG. 5 can be designed to utilize the range of first web interconnections depicted by the maximum interconnection of FIG. 6 or the minimum interconnection of FIG. 7 or any amount of interconnection in between these limits.

It should be understood that while certain preferred embodiments are shown herein, it is intended to cover all alternatives, modifications and equivalents as may be included within the spirit and scope of the invention as defined by the appended claims.

We claim:

1. In a carrier device for multipackaging a plurality of cylindrical containers in two adjacent rows, said carrier device formed from an elastic plastics sheet material, said carrier device comprising two rows of integrally interconnected bands lying in the plane of said sheet material, each of said bands having a container receiving aperture, the initial circumferential dimension of each aperture being less than the circumferential dimension of the surface of the container intended to be encircled by one of said bands, a plurality of first and second web means, each of said first web means interconnecting one transversely aligned pair of bands in said two rows, each of said second web means interconnecting one longitudinally adjacent pair of bands in each row, each of said bands comprising an outer section and an inner section extending between said second web means creating an initial aperture configuration, said outer sections disposed along the outer side marginal edges of said carrier device presenting substantially a straight line configuration, and said inner sections disposed between said outer sections and between said first and second web means, each of said inner sections being substantially V-shaped in configuration in the plane of said carrier device and defined generally by a pair of legs extending inwardly relative to the outer section and intersecting at an apex region, each of said first web means having a total length overlapping a portion of outer margin of each pair of said legs in the longitudinal direction between said two rows defined by extremities, each extremity interconnecting a pair of opposing legs of transversely aligned inner sections on either side of the apex regions of said transversely aligned inner sections, wherein stretching forces applied in transversely outward opposite directions to transversely aligned outer sections of said bands change the initial aperture configuration and its circumferential dimension to a second aperture configuration having a dimension substantially equal and similar to a complementary cylindrical container adapted to be associated therewith by axial insertion and subsequent encirclement as a result of the first web means transferring the stretching forces to the inner sections in force directions substantially perpendicular to the longitudinal axis of the carrier device.

2. The carrier device of claim 1, wherein each of the first web means comprises a plurality of longitudinally spaced, laterally directed strap elements including a pair of aperture reconfiguring strap elements disposed on either side of a central strap element, said central strap element connecting apex regions of said transversely aligned inner sections, said pair of aperture reconfiguring strap elements defining the longitudinal extremities of the first web means and thereby interconnecting opposing legs of transversely, aligned inner sections on either side of their apex regions.

3. The carrier device of claim 1, wherein the inner sections further include a pair of longitudinally space band portions extending substantially perpendicular to the outer side marginal edges, each interconnecting one extremity of the outer section to one extremity of an associated leg, the second web means interconnecting longitudinally adjacent perpendicularly extending band portions.

4. The carrier device of claim 1, wherein the initial circumferential configuration of each aperture is generally triangular.

5. The carrier device of claim 1, wherein the initial circumferential configuration of each aperture is generally pentagonal.

6. The carrier device of claim 2, wherein the central strap element has a limited width generally not exceeding twice the width of the inner section of the band in the vicinity of the apex.

7. The carrier device of claim 2, wherein the width of the band in the inner section intermediate the pair of longitudinally spaced strap elements is less than the width of the band in the remaining portions of the inner section and the outer section.

8. The carrier device of claim 3, wherein the width of outer section of the band at the corners created by the intersection of the outer section with the perpendicular, longitudinally spaced band portions is greater than at the region of the outer section intermediate these corner regions.

9. The carrier device of claim 1, wherein portions of transversely aligned inner sections intermediate the extremities of the first web means are separated thus reducing the effective length of interconnection between the transversely aligned pair of bands.

10. The carrier device of claim 1, wherein finger receiving apertures are formed between longitudinally adjacent pairs of bands, the margin of said apertures created by laterally opposing second web means, longitudinally opposing extremities of said first web means, and outer marginal edges of laterally adjacent and longitudinally adjacent leg portions of associated bands.

11. The carrier device of claim 1, wherein the initial circumferential configuration of each aperture is generally polygonal with the inner marginal portions formed by the outer band sections and legs of the inner band sections each having a radius of curvature substantially greater than the radius of curvature of the container intended to be encircled by said band.

12. Carrier stock for machine application to a plurality of containers to form packages of said containers, said stock formed from a resilient deformable plastic sheet material of uniform thickness and comprising two rows of integrally joined flat bands forming laterally aligned pairs of apertures adapted to encircle and retain containers therein, the apertures created by each of said bands have an initial circumferential dimension less than the circumferential dimension of the surface of the container intended to be encircled by said bands, each aperture also having an initial configuration which is noncircular, and elongated in the longitudinal direction of the strip, a plurality of first and second web means associated with said bands arranged and configured to deform the apertures from their initial, noncircular configuration, to a second, generally circular configuration, responsive to laterally directed stretching forces applied solely at laterally opposed outer side marginal regions of the stock, each of said first web means interconnecting one transversely aligned pair of bands in said two rows, each of said second web means interconnecting one longitudinally adjacent pair of bands in each row, each of the bands including a yoke-like inner section and an outer section, each yoke-like inner section including generally straight leg regions and a centrally disposed interconnect region, the leg regions extending inwardly from regions of maximum length of the elongated apertures toward the longitudinal center line of the carrier stock and also inwardly toward a line perpendicularly disposed to the longitudinal center line and which line extends generally through the center of each pair of laterally aligned apertures and through the interconnect region of the opposing inner sections, the first web means extending between and integrally connecting laterally opposed pairs of bands, each of said first web means having a total length greater than the length of the interconnect region and less than the maximum length of the elongated apertures with each longitudinal extremity of said first web means interconnecting a pair of laterally opposed leg regions on both sides of said line which is disposed perpendicularly to the longitudinal center line, the outer section of each band being generally straight with the extremities thereof being integrally interconnected to the extremities of each of the inwardly directed leg portions, the outer section generally defining the maximum length of the aperture, the second web means having a dimension extending transverse the stock which is less than the transverse dimension of the bands along said line perpendicularly disposed to the longitudinal center line of the stock wherein the application of stretching forces at the inner margin of the outer section of each opposing pair of bands causes the first web means to act on the inner section in such a manner as to transform the aperture to a generally circular configuration while minimizing localized stresses at any region of the bands and transmitting the lateral stretching forces through the first web means to the inner band sections substantially perpendicular to the longitudinal center line of the stock.

13. The carrier stock of claim 12, wherein each of the first web means comprises a plurality of longitudinally spaced, laterally directed strap elements including a pair of aperture reconfiguring strap elements disposed on either side of a central strap element, said central strap element connecting opposed centrally disposed interconnect regions of transversely aligned inner sections, said pair of aperture reconfiguring strap elements defining the longitudinal extremities of the first web means and thereby interconnecting transversely opposing leg portions of said inner sections.

14. The carrier stock of claim 12, wherein each of the first web means includes a pair of laterally directed strap elements disposed on either side of the centrally disposed interconnect region, each strap element of said pair connecting a pair of laterally opposed leg regions, with the laterally opposing centrally disposed interconnect regions being unconnected.

15. The carrier stock of claim 12, wherein each of the first web means substantially connects laterally opposing centrally disposed interconnect region and leg regions intermediate the longitudinal extremities of said first web means.

16. In a carrier device for multipackaging a plurality of cylindrical containers in two adjacent rows, said carrier device formed from an elastic plastics sheet material, said carrier device comprising two rows of integrally interconnected bands lying in the plane of said sheet material, each of said bands having a container receiving aperture, the initial circumferential dimension of each aperture being less than the circumferential dimension of the surface of the container intended to be encircled by one of said bands, a plurality of first and second web means, each of said first web means interconnecting one transversely aligned pair of bands in said two rows each of said second web means interconnecting one longitudinally adjacent pair of bands in each row, each of said bands comprising an outer section and an inner section extending between said second web means creating an initial aperture configuration, the initial aperture configuration defined by each band being noncircular and elongated in the longitudinal direction of the device, a first dimension of the aperture located along an axis extending between adjacent second web means being greater than a second dimension of the aperture located along an axis extending between the areas of maximum lateral separation between the outer band section and inner band section, each of the first web means interconnecting laterally adjacent inner band sections, the length of the first web means being less than the length of the first dimension, the first web means including longitudinal extremities equally spaced on either side of the axis whch locates said second dimension, each first web means defining a plurality of longitudinally spaced, limited width, discrete, laterally directed straps, the plurality of straps including a pair of aperture reconfiguring strap elements of substantially equal width and lateral length, disposed on either side of, and equally spaced from, the axis locating said second dimension, said pair of aperture reconfiguring strap elements thereby defining the longitudinal extremities of the first web means and, in cooperation with the second web means serving to maximize the independent functioning of each band as a resilient container retaining means while reconfiguring the noncircular aperture to an aperture of a configuration adapted to be fitted around an associated cylindrical container.

17. The carrier device of claim 16 further including a central strap element of limited width and having a lateral length less than the lateral length of the pair of aperture reconfiguring strap elements located on the axis which defines the location of the second dimension.

* * * * *